US006199376B1

(12) United States Patent
Maeda

(10) Patent No.: US 6,199,376 B1
(45) Date of Patent: Mar. 13, 2001

(54) EXTENSION OF EXHAUST MANIFOLD CONDUIT INTO EXHAUST PIPE

(75) Inventor: Fumihiko Maeda, Minamika wachi-machi (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/161,645

(22) Filed: Sep. 28, 1998

(51) Int. Cl.[7] ..... F01N 7/10
(52) U.S. Cl. ..... 60/323; 60/313
(58) Field of Search ..... 60/313, 323; 29/890.08

(56) References Cited

U.S. PATENT DOCUMENTS

| | | | | |
|---|---|---|---|---|
| 4,022,019 | | 5/1977 | Garcea | 60/282 |
| 4,182,121 | | 1/1980 | Hall | 60/313 |
| 4,621,494 | | 11/1986 | Fujita | 60/313 |
| 4,796,426 | | 1/1989 | Feuling | 60/313 |
| 4,815,274 | * | 3/1989 | Piatti | 60/313 |
| 5,390,494 | | 2/1995 | Cleg | 60/299 |
| 5,606,857 | * | 3/1997 | Harada | 60/322 |
| 5,636,515 | | 6/1997 | Matsumoto et al. | 60/323 |
| 5,655,362 | | 8/1997 | Kawajiri et al. | 60/276 |
| 5,726,397 | | 3/1998 | Mukai et al. | 181/232 |
| 5,727,386 | | 3/1998 | Watanabe et al. | 60/323 |
| 5,761,905 | | 6/1998 | Yamada et al. | 60/322 |
| 5,787,709 | * | 8/1998 | Watanabe et al. | 60/313 |
| 5,799,395 | | 9/1998 | Nording et al. | 29/890.08 |

FOREIGN PATENT DOCUMENTS 57-58330 12/1982 (JP) .

* cited by examiner

*Primary Examiner*—Thomas Denion
*Assistant Examiner*—Binh Tran
(74) *Attorney, Agent, or Firm*—Morgan & Finnegan, L.L.P.

(57) ABSTRACT

An exhaust manifold for an internal combustion engine includes a set of exhaust manifold conduits. Pairs of the exhaust manifold conduits converge and are joined at their downstream portions. The pairs of exhaust manifold conduits are connected to associated downstream exhaust pipes. In each pair, a first exhaust manifold conduit having a first downstream portion extends into the exhaust pipe, and a second exhaust manifold conduit having a second downstream portion terminates at the inlet end of the exhaust pipe. A channel is defined by the body of the exhaust pipe and the flat side wall of the first downstream portion. The channel has a cross-sectional configuration approximately the size and shape of the second downstream portion and communicates with the second downstream portion. Each exhaust manifold conduit includes an inner pipe disposed within an outer pipe for reduced thermal dissipation to promote a quicker light-off of the catalytic converter. Extension of the first downstream portion into the exhaust pipe effectively lengthens both the first exhaust manifold conduit and the second exhaust manifold conduit, which increases the engine torque at lower RPMs.

16 Claims, 10 Drawing Sheets

EXTENSION OF EXHAUST MANIFOLD CONDUIT INTO EXHAUST PIPE

BACKGROUND OF THE INVENTION

1. Field of the Invention

This invention relates generally to exhaust manifolds for internal combustion engines, and more particularly to extending an exhaust manifold conduit into a downstream exhaust pipe.

2. Description of the Related Art

In a "four-into-two-into-one" exhaust system for a four-cylinder engine, the primary exhaust manifold conduits from a first pair of cylinders communicate into a separate secondary exhaust pipe, and the primary exhaust manifold conduits from a second pair of cylinders communicate into another separate secondary exhaust pipe. The two secondary exhaust pipes are joined together into a single downstream tailpipe.

When a pair of exhaust manifold conduits delivers two streams of exhaust gas into the mouth of a downstream exhaust pipe, from different directions, turbulence is created at the mouth. Eddies, which are currents of exhaust gas running contrary to the main current, tend to build up along the wall of the downstream exhaust pipe where friction impedes exhaust gas flow. The eddies hinder movement of exhaust gases from the upstream cylinders. Turbulence and eddies in the flowing exhaust gas cause back pressure, which reduces engine performance.

Expansion of the exhaust gas occurs at each junction until final expansion at the open end of the tailpipe. Rarefaction waves return as reflections from the expansion of the exhaust gas at the junctions and tend to push the exhaust gas back into the cylinders.

The length of an exhaust conduit from the exhaust port of a cylinder to a junction at which the conduit merges with one or more other conduits is known as "the resonant length". The resonant length of the exhaust conduit determines, at least in part, the period of the rarefaction wave.

The rate of closing of a valve (or set of valves) in the exhaust port depends on the revolutions per minute ("RPM") of the engine. For a particular range of engine RPMs, the period of the rarefaction wave will not coincide with periodic valve closure in the exhaust port if the resonant length is not within a certain range of lengths.

If the period of the rarefaction wave does not coincide with the period of valve closure in the exhaust port for certain engine RPMs, the rarefaction wave will not impinge at the exhaust port when the valve is closed therein, and will tend to push exhaust gas back into the cylinder while the valve is not closed.

Increasing the resonant length affects the period of the rarefaction wave, and can cause the rarefaction wave to impinge at the exhaust port in synchronization with the closing of the valve therein. It is, however, often difficult to fit additional conduit length into an engine compartment. As such, there is currently a need for an exhaust system which eliminates or reduces these concerns.

SUMMARY OF THE INVENTION

According to an exemplary embodiment of the invention, an exhaust manifold for an internal combustion engine includes a set of exhaust manifold conduits. The exhaust manifold conduits converge together in pairs, and are joined at their downstream portions. An exhaust pipe having a body defining an inlet end is associated with each pair.

In each pair, a first exhaust manifold conduit includes a first downstream portion that extends an additional length into the exhaust pipe, while a second exhaust manifold conduit includes a second downstream portion that terminates at the inlet end of the exhaust pipe. The additional length of the first downstream portion that extends into the exhaust pipe defines a channel between the body of the exhaust pipe and the inward flat side wall of the first downstream portion. The channel has a cross-sectional configuration approximately the size and shape of the second downstream portion. The second exhaust manifold conduit communicates with the channel.

Other features and advantages of the invention will become apparent from the following detailed description, taken in conjunction with the accompanying drawings, which illustrate, by way of example, the features of the invention.

DETAILED DESCRIPTION

Figure 1:
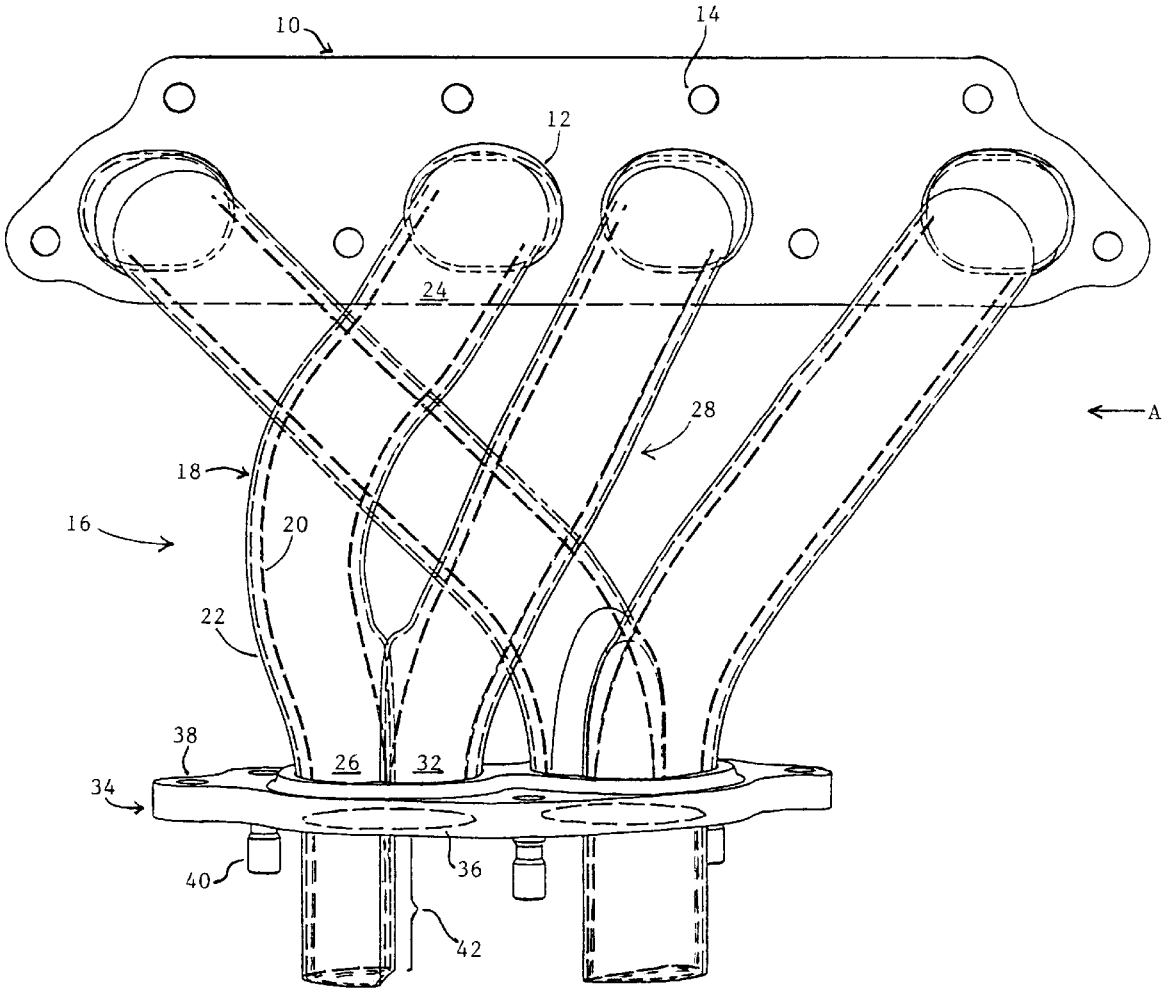
FIG. 1 is a perspective view of an exhaust manifold in accordance with the principles of the invention.

As shown in the drawings for purposes of illustration, the invention is embodied in an exhaust manifold including a first exhaust manifold conduit and a second exhaust manifold conduit connected to a downstream exhaust pipe. The exhaust pipe has a body defining an inlet end. The first exhaust manifold conduit has a first downstream portion that extends into the exhaust pipe an additional length. The second exhaust manifold conduit has a second downstream portion that terminates at the inlet end of the exhaust pipe.

The first and second downstream portions each have a substantially "D-shaped" cross-sectional configuration (i.e., the shape presented by a straight line connecting the ends of the arc of a semi-circle or another curved shape), which presents a flat side wall. The first and second downstream portions present a combined cross-sectional configuration that will fit into an outlet opening that has a substantially circular cross-sectional configuration.

A channel is defined within the exhaust pipe by the body of the exhaust pipe and the inward (toward the center line of the exhaust pipe) flat side wall of the first downstream portion extending into the exhaust pipe. The channel has a cross-sectional configuration approximately the same size and shape as the second downstream portion and communicates therewith.

Each exhaust manifold conduit is preferably made from an inner pipe disposed within an outer pipe. The outer pipe thermally insulates the inner pipe. This reduces the dissipation of heat from the exhaust gas moving in the inner pipe such that a catalytic converter downstream can be quickly activated after the start of the engine to remove hydrocarbon and other harmful components contained in the exhaust gas.

The extension of the first downstream portion of the first exhaust manifold conduit into the exhaust pipe effectively increases the length of both exhaust manifold conduits (i.e., the first exhaust manifold conduit by the length of the extension, and the second exhaust manifold conduit by the length of the channel) without changing the cross-sectional configuration of either downstream portion.

The length of the extension of the first downstream portion is selected such that the period of the rarefaction wave causes the rarefaction wave to impinge at the exhaust port in synchronization with the closing of the valve (or set of valves) therein to increase the engine torque at lower RPM ranges. The extension also separates the first and second streams of exhaust gas from the first exhaust manifold conduit and the second exhaust manifold conduit, respectively, along the additional length of the extension. Back pressure is decreased because the first and second exhaust gas streams are flowing closer to the same direction when they merge together further downstream. These and other features of the preferred embodiments of the invention will become more fully apparent with reference to the drawings.

FIG. 1 is a perspective view of an exhaust manifold in accordance with the principles of the invention. With reference to FIG. 1, the exhaust manifold includes a first inlet flange 10. The first inlet flange 10 defines a first set of inlet openings 12. When the first inlet flange 10 is mounted to an internal combustion engine (not shown), the first set of inlet openings 12 is registered with exhaust ports of the cylinders of the internal combustion engine. The first inlet flange 10 defines a set of bolt holes 14 through which a bolt or other fastener can be inserted to align the first inlet flange 10 to the exhaust ports.

The exhaust manifold shown in FIG. 1 includes a set of discrete exhaust manifold conduits 16 that are inserted into and held by friction-fitting with the first set of inlet openings 12 of the first inlet flange 10 so that exhaust gas can pass from a cylinder through an associated inlet opening 12 into an associated exhaust manifold conduit 18. Four exhaust manifold conduits and four inlet openings are illustrated in FIG. 1.

Each exhaust manifold conduit 18 of the set 16 is made from an inner pipe 20 and an outer pipe 22 disposed around the inner pipe 20. Space between the outer pipe 22 and the inner pipe 20 thermally insulates the inner pipe 20. This reduces heat dissipation from the inner pipe 20 by conduction or convection, whereby a faster light-off of a catalytic converter downstream is attained. Each exhaust manifold conduit 18 presents an upstream portion 24 connected through the first inlet flange 10 to the exhaust port of a cylinder of an internal combustion engine. Each exhaust manifold conduit 18 presents a downstream portion 26. The downstream portion 26 of each exhaust manifold conduit 18 has a D-shaped cross-sectional configuration and presents a flat side wall.

The exhaust manifold conduits converge in pairs, and are joined together at their respective downstream portions. In each pair, the first exhaust manifold conduit 18 is designed to extend an additional length, as compared to the second exhaust manifold conduit 28, through an outlet opening downstream into an exhaust pipe. When paired, the flat side wall of the first downstream portion 26 is in confronting relation with the flat side wall of the second downstream portion 32. The downstream portion 26 of the first exhaust manifold conduit 18 is displaced from the downstream portion 32 of the second exhaust manifold conduit 28 by the additional length of extension.

The exhaust manifold shown in FIG. 1 includes an outlet flange 34 coupled to the set of exhaust manifold conduits 16. The outlet flange 34 defines a set of outlet openings 36 receiving respective pairs of exhaust manifold conduits. The outlet flange 34 defines a set of bolt holes 38 through which bolts 40 or other fasteners can extend to couple the outlet flange 34 to exhaust pipes downstream from the exhaust manifold.

Two pairs of exhaust manifold conduits are frictionally engaged into respective outlet openings defined by the outlet flange 34, and then welded. The opposing first and second downstream portions 26, 32 are joined, such as by welding, such that the flat side wall of the first downstream portion 26 is in confronting relation with the flat side wall of the second downstream portion 32.

The first and second exhaust manifold conduits 18, 28 are associated with the outlet opening 36. An exhaust pipe can be coupled to each outlet opening. The first downstream portion 26 extends into the exhaust pipe an additional distance 42. The second downstream portion 32 is not extended downstream into the associated exhaust pipe.

Figure 2:
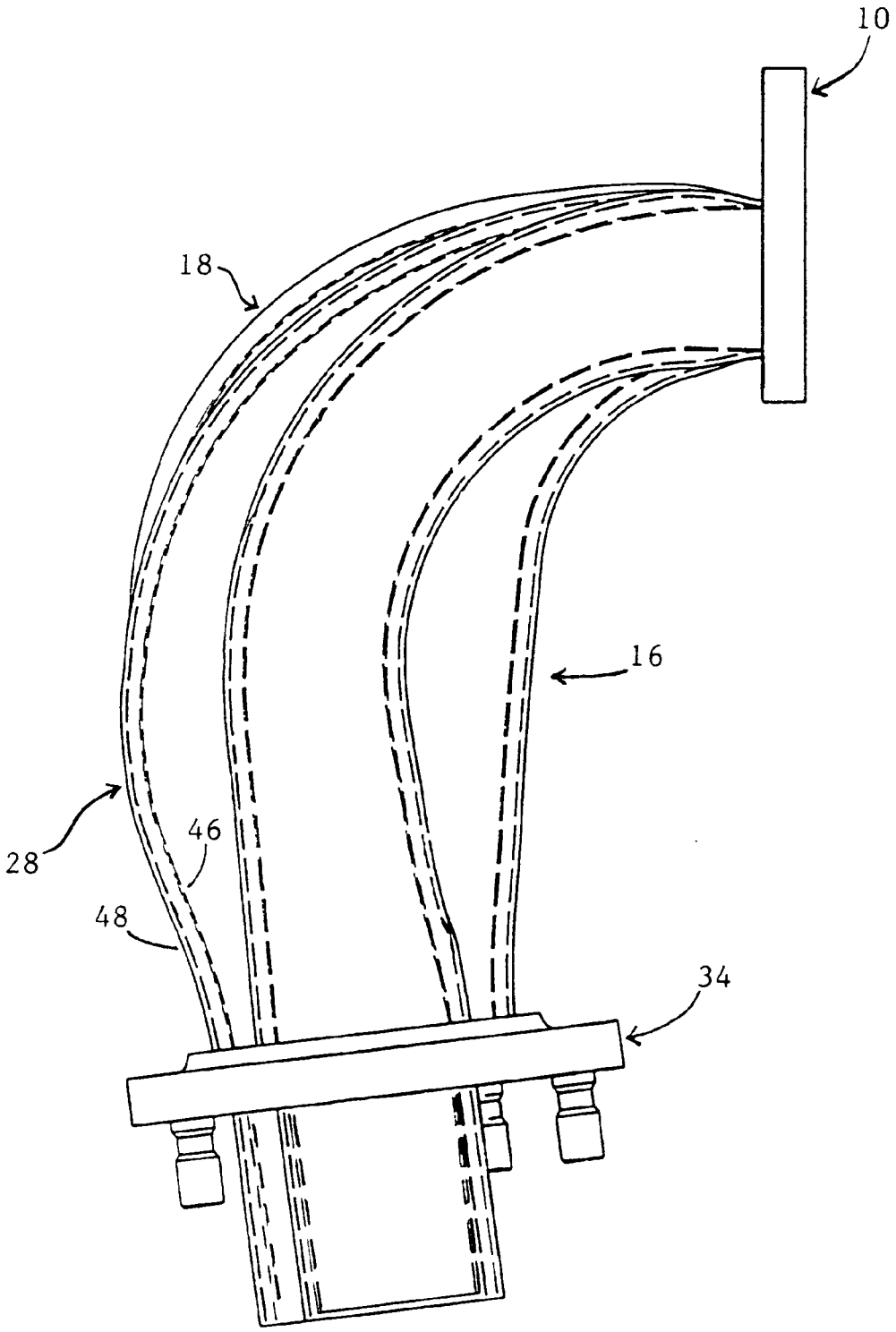
FIG. 2 is a side view taken in the direction of the arrow A of FIG. 1.

FIG. 2 shows a side view of the exhaust manifold taken in the direction of the arrow A of FIG. 1. With reference to FIG. 2, the set of exhaust manifold conduits 16 is coupled to the inlet openings of the first inlet flange 10. The second exhaust manifold conduit 28 is made from an inner pipe 46 disposed within an outer pipe 48.

Figure 3:
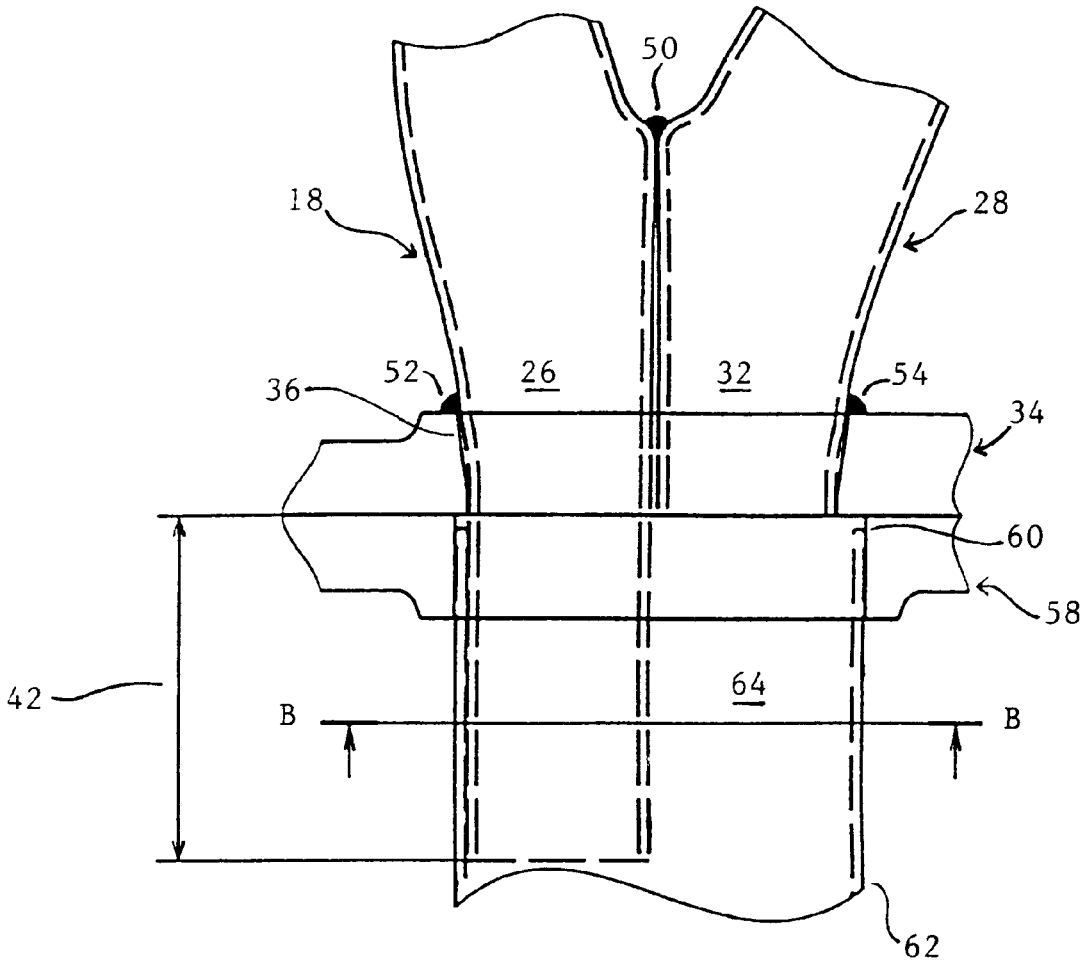
FIG. 3 is a plan view of a pair of exhaust manifold conduits coupled to a downstream exhaust pipe in accordance with the principles of the invention.

FIG. 3 is a plan view of the pair of first and second exhaust manifold conduits 18, 28 coupled to an exhaust pipe in accordance with the principles of the invention. With reference to FIG. 3, the first and second downstream portions 26, 32 of the pair of exhaust manifold conduits 18, 28 converge toward each other. An upper weld 50 joins an upper welding portion of both of the exhaust manifold conduits 18, 28. A lower weld (not shown) joins a lower welding portion of both of the exhaust manifold conduits 18, 28. The paired first and second downstream portions 26, 32 are inserted into the outlet opening 36 and secured therein by peripheral welds 52, 54.

A second inlet flange 58, downstream from the outlet flange 34, connects a set of exhaust pipes to the outlet flange 34. The second inlet flange 58 is flush with and held in confronting relation with the outlet flange 34 by way of bolts or other fasteners (not shown) such that the outlet opening 36 defined by the outlet flange 34 is registered with the second inlet opening 60 defined by the second inlet flange 58.

The second downstream portion 32 terminates at the inlet end of the exhaust pipe 62. The first downstream portion 26 has an additional length 42 that extends into the exhaust pipe 62. A channel 64 is defined by the body of the exhaust pipe 62 and the additional length 42 of the first downstream portion 26 extending into the exhaust pipe 62. The channel 64 has a substantially similar cross-sectional size and D-shape as that of the second downstream portion 32, which does not extend downstream into the exhaust pipe 62.

Extending one exhaust manifold conduit of a pair into the downstream exhaust pipe as taught herein effectively lengthens both exhaust manifold conduits because the second exhaust manifold conduit 28 can communicate exhaust gas flow into the channel 64. Extending one exhaust manifold conduit requires fewer manufacturing steps than extending both of the exhaust manifold conduits.

Figure 4:
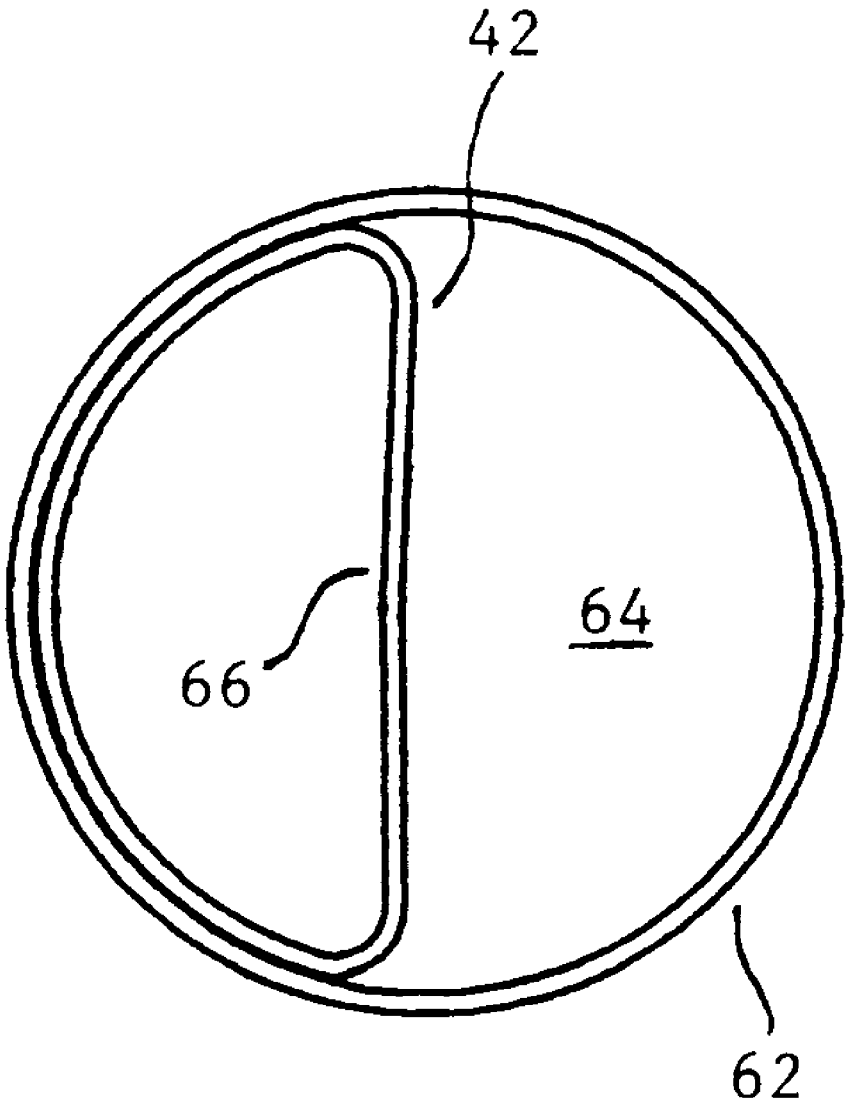
FIG. 4 is a sectional view taken along the line B—B of FIG. 3.

FIG. 4 shows a sectional view taken along the line B—B of FIG. 3. With reference to FIG. 4, the exhaust pipe 62 encases the additional length 42 of the first downstream portion 26 (FIG. 3) that extends into the exhaust pipe 62. The first downstream portion 26 presents a flat side wall 66 toward the center line of the exhaust pipe 62. The body of the exhaust pipe 62 and the flat side wall 66 define the channel 64. The channel 64 has a cross-sectional configuration approximating that of the second downstream portion 32 (FIG. 3).

In the preferred embodiment of the invention, each exhaust manifold conduit includes inner and outer pipes, and the inner and outer pipes are made from austenitic stainless steel. Other suitable materials, however, can be used. In one embodiment of the present invention, the thickness of the inner pipe is substantially equal to 0.6 mm and the thickness of the outer pipe is substantially equal to 1.4 mm.

The first stream of exhaust gas from the first exhaust manifold conduit and the second stream of exhaust gas from the second exhaust manifold conduit flow further into the exhaust pipe before merging together, which reduces turbulence and improves engine performance in a way that comports with the limited available space in an engine compartment.

Extending one exhaust manifold conduit, rather than both, is more easily accommodated within the exhaust pipe. Extending two exhaust manifold conduits would be more difficult to fit into the volume or cross-sectional area of the exhaust pipe.

Figure 5:
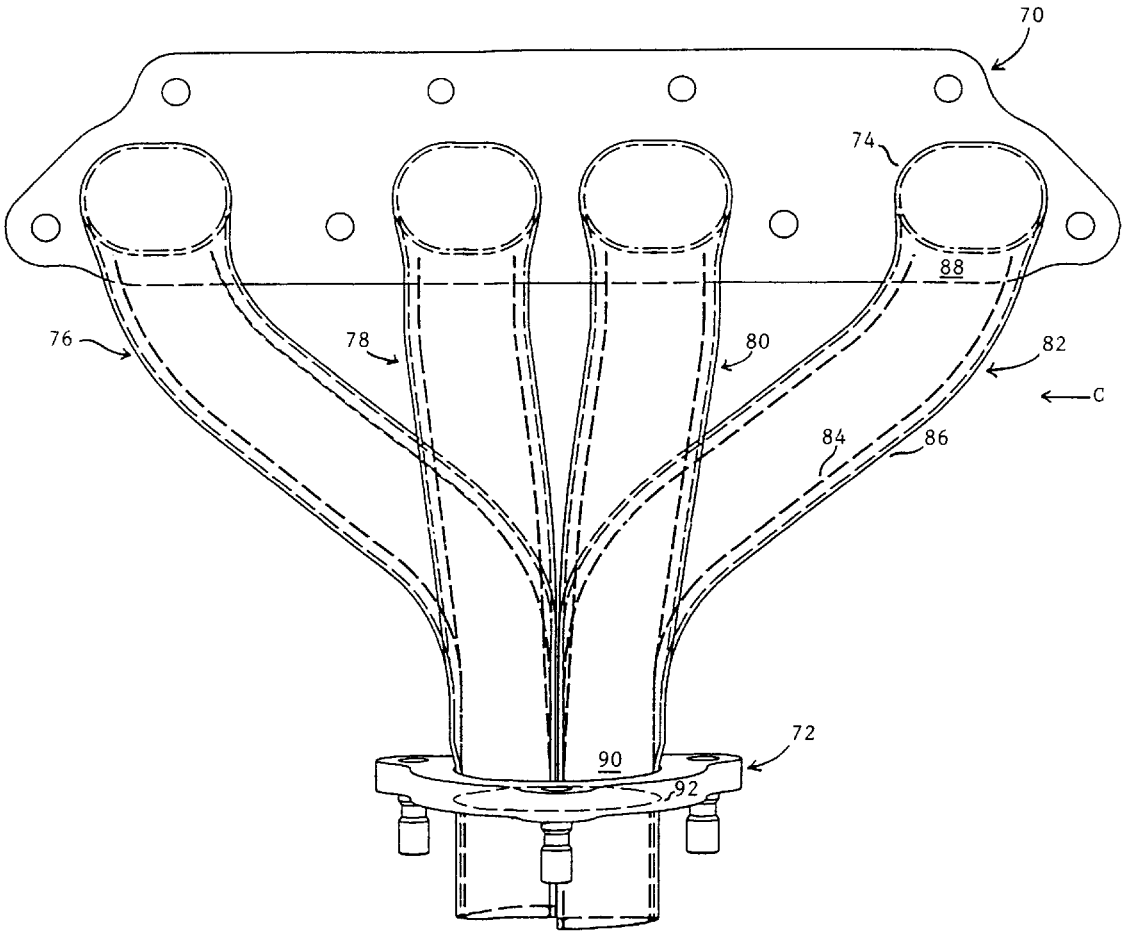
FIG. 5 is a perspective view of an exhaust manifold in accordance with the principles of the invention.
Figure 6:
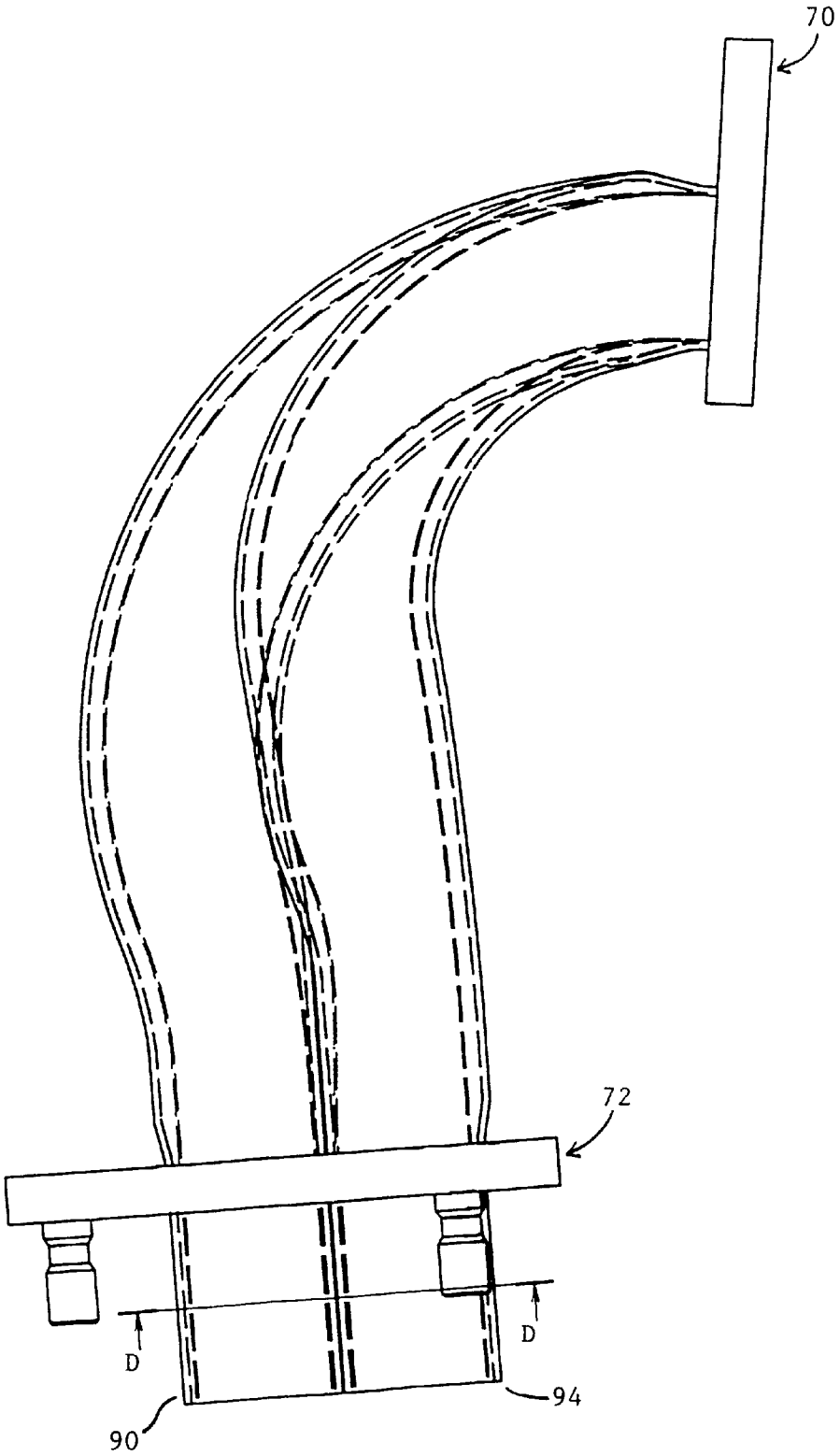
FIG. 6 is a side view taken in the direction of the arrow C of FIG. 5.
Figure 7:
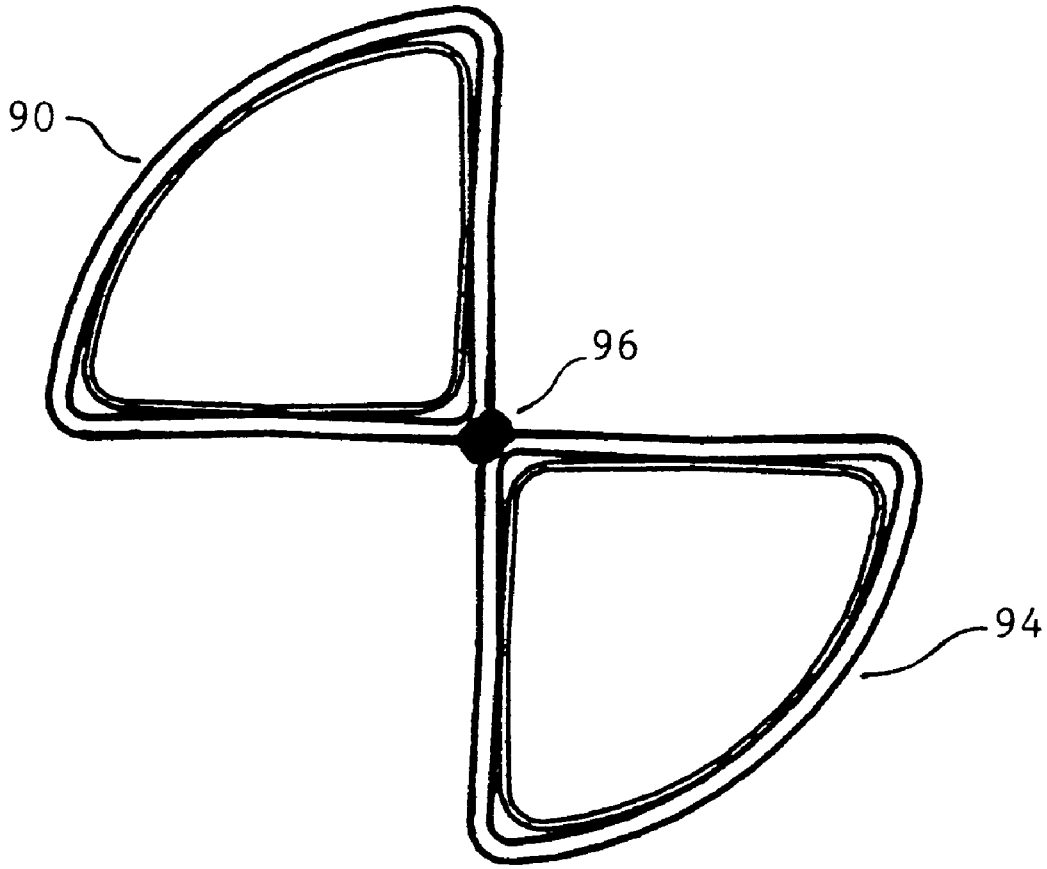
FIG. 7 is a sectional view taken along the line D—D of FIG. 6.

FIGS. 5, 6 and 7 illustrate another embodiment of the invention, in which all four exhaust manifold conduits converge downstream at the inlet end of one exhaust pipe. The downstream portions of the exhaust manifold conduits each have a generally triangular wedge-shaped cross-sectional configuration. In this specific embodiment of the invention, two of the exhaust manifold conduits extend an additional length into the exhaust pipe.

FIG. 5 is a perspective view of an exhaust manifold in accordance with the principles of the invention. The exhaust manifold illustrated in FIG. 5 includes an inlet flange 70 and an outlet flange 72 downstream from the inlet flange 70. An exhaust pipe (not shown), having a body defining an inlet end, can be coupled to the downstream face of the outlet flange 72 of the exhaust manifold.

The inlet flange 70 defines a set of inlet openings 74. When the inlet flange 70 is mounted to an internal combustion engine, the set of inlet openings 74 is registered with the cylinder exhaust ports.

The exhaust manifold shown in FIG. 5 includes a first exhaust manifold conduit 76, a second exhaust manifold conduit 78, a third exhaust manifold conduit 80 and a fourth exhaust manifold conduit 82. Each exhaust manifold conduit is made from an inner pipe 84 and an outer pipe 86 disposed around the inner pipe 84.

Each exhaust manifold conduit has an upstream portion, such as upstream portion 88, which is connected through the inlet flange 70 to a cylinder exhaust port such that exhaust gases can pass from the cylinder through the associated exhaust manifold conduit during operation. Each exhaust manifold conduit has a downstream portion, such as downstream portion 90 of the fourth exhaust manifold conduit 82. The downstream portion of each exhaust manifold conduit has a triangular wedge-shaped cross-sectional configuration and presents a convex perimeter wall and a pair of concave interior side walls.

The outlet flange 72 defines an outlet opening 92. The outlet opening 92 has a substantially circular cross-sectional configuration.

The first exhaust manifold conduit 76, the second exhaust manifold conduit 78, the third exhaust manifold conduit 80 and the fourth exhaust manifold conduit 82 converge and are joined together at their respective downstream portions. According to the principles of the invention, the downstream portions of a first number of the exhaust manifold conduits extend into an attached exhaust pipe; and the downstream portions of a second number of the exhaust manifold conduits terminate at the inlet end of the attached exhaust pipe.

In the illustrative embodiment depicted in FIG. 5, the downstream portion of the second exhaust manifold conduit 78 and the downstream portion of the fourth exhaust manifold conduit 82 extend through and protrude from the outlet opening 92. The first exhaust manifold conduit 76 and the third exhaust manifold conduit 80 terminate in the outlet flange 72.

FIG. 6 shows a side view of the exhaust manifold taken in the direction of the arrow C of FIG. 5. With reference to FIG. 6, the exhaust manifold conduits are coupled to the respective inlet openings of the inlet flange 70. The downstream portion 94 of the second exhaust manifold conduit 78 and the downstream portion 90 of the fourth exhaust manifold conduit 82 extend through the outlet flange 72.

FIG. 7 is a sectional view taken along the line D—D of FIG. 6. With reference to FIG. 7, the downstream portion 90 of the fourth exhaust manifold conduit and the downstream portion 94 of the second exhaust manifold conduit are preferably positioned diagonally across from each other through the outlet opening 92 (FIG. 5), extending into a downstream exhaust pipe. An exhaust pipe will, when connected to the outlet flange 72 by a fastener such as another inlet flange, encase the downstream portion 94 of the second exhaust manifold conduit and the downstream portion 90 of the fourth exhaust manifold conduit protruding from the outlet flange 72. The downstream portion of the first exhaust manifold conduit 76 (FIG. 5) and the downstream portion of the third exhaust manifold conduit 80 (FIG. 5) terminate in the outlet opening 92 at the inlet end of an attached exhaust pipe.

The body of the exhaust pipe surrounds and contains the downstream portions 94, 90 of the second exhaust manifold conduit 78 and the fourth exhaust manifold conduit 82, respectively, which creates two channels positioned diagonally across from each other. Each channel has substantially the same cross-sectional size and shape as the associated downstream portion of the first exhaust manifold conduit 76 or the third exhaust manifold conduit 80 with which it communicates. The channels within the exhaust pipe have a total cross-sectional area that is approximately the same as the total cross-sectional area of the downstream portions 94, 90 of the second and fourth exhaust manifold conduits. The downstream portion 90 of the fourth exhaust manifold conduit 82 and the downstream portion 94 of the second exhaust manifold conduit 78 are welded to each other at weld 96.

Figure 8:
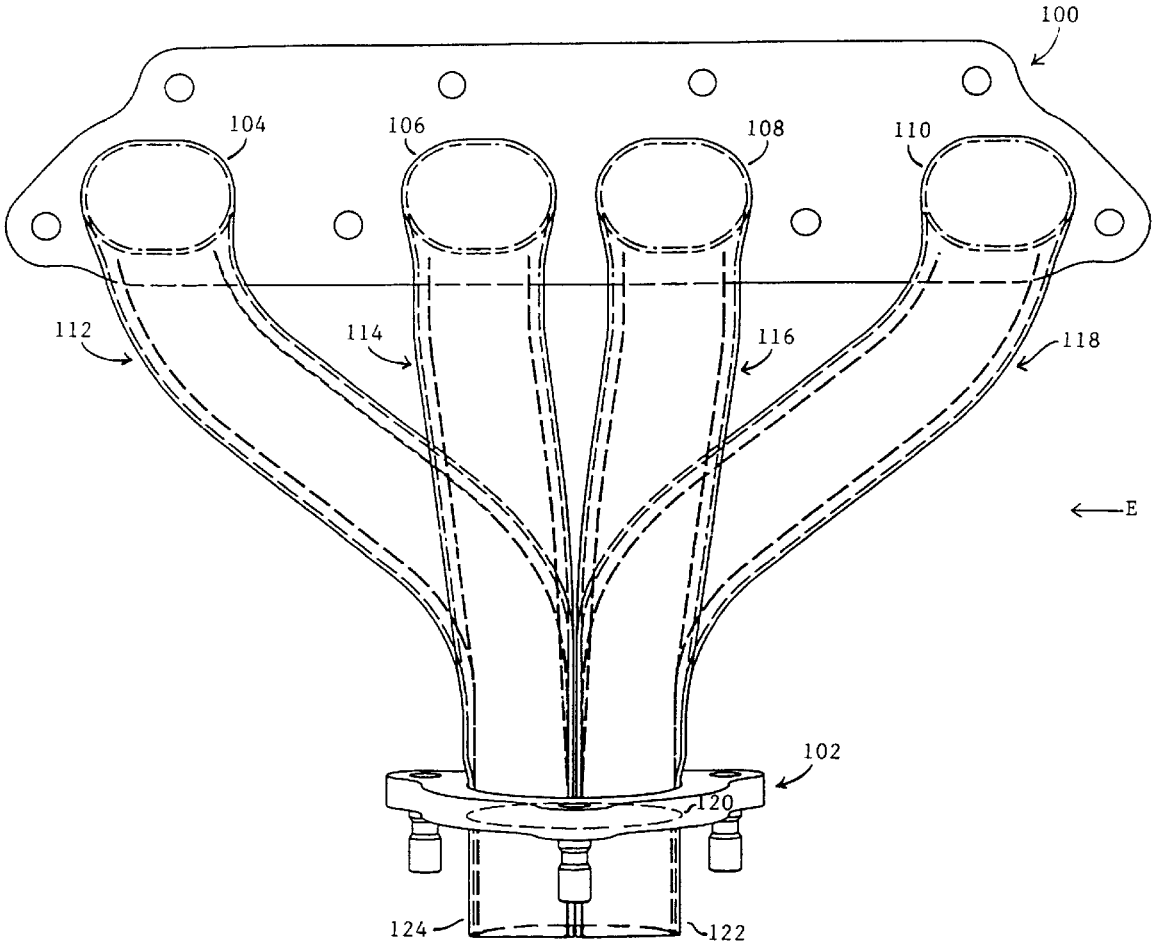
FIG. 8 is a perspective view of an exhaust manifold in accordance with the principles of the invention.
Figure 9:
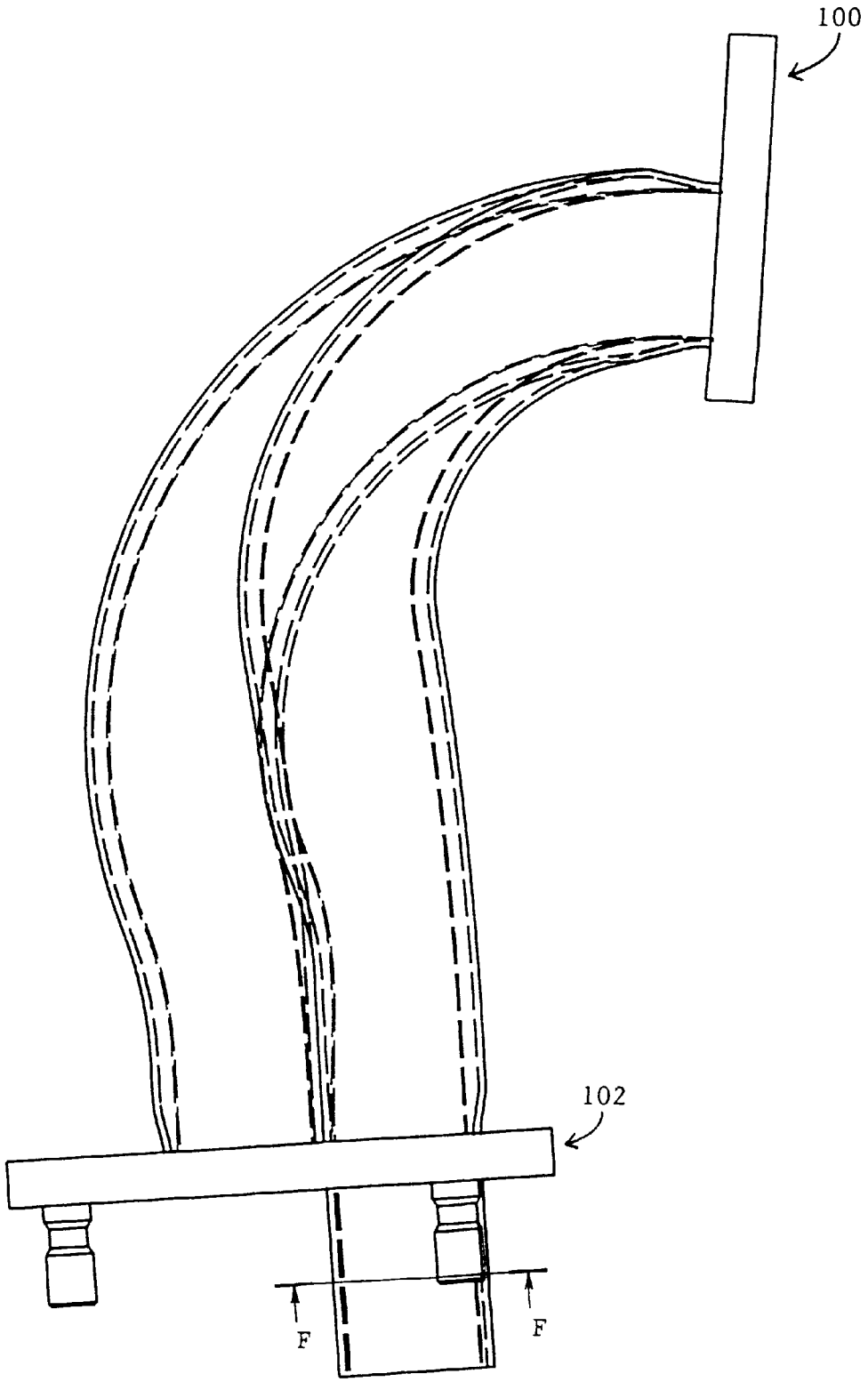
FIG. 9 is a side view taken in the direction of the arrow E of FIG. 8.
Figure 10:
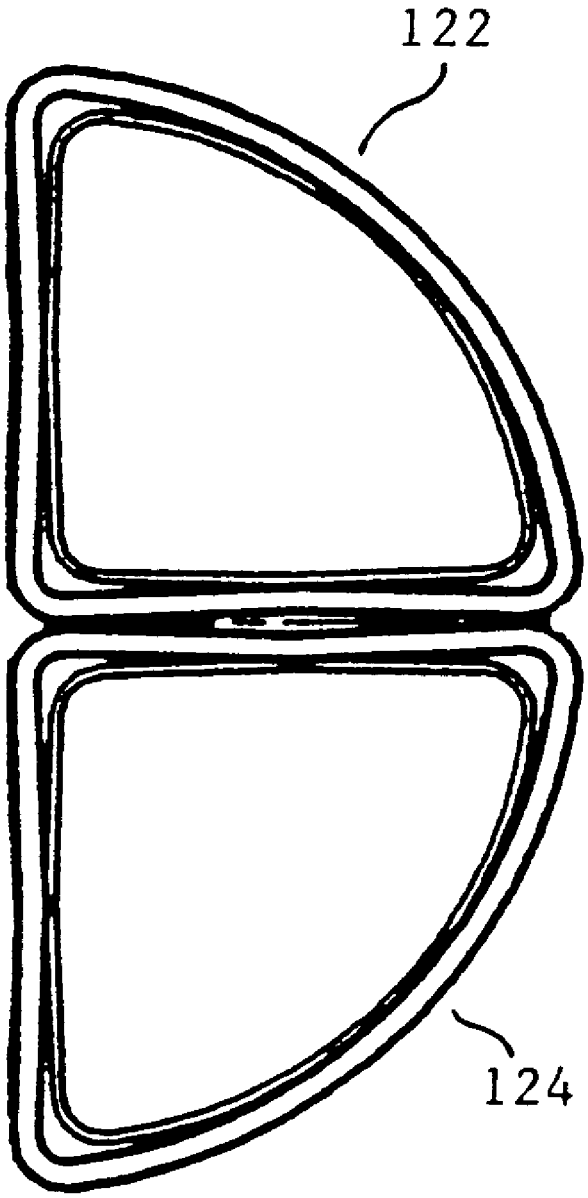
FIG. 10 is a sectional view taken along the line F—F of FIG. 9.

FIGS. 8, 9 and 10 depict another embodiment of the invention in which all four exhaust manifold conduits converge downstream to the inlet end of an attached exhaust pipe. Each of the downstream portions of the exhaust manifold conduits have a generally triangular wedge-shaped cross-sectional configuration. Two of the downstream portions extend an additional length from the downstream face of the outlet flange into the attached exhaust pipe.

The exhaust manifold illustrated in FIG. 8 includes an inlet flange 100 and an outlet flange 102 downstream from the inlet flange 100. An exhaust pipe (not shown) can be coupled to the outlet flange 102.

The inlet flange 100 defines a set of inlet openings. The set of inlet openings includes a first inlet opening 104, a second inlet opening 106, a third inlet opening 108 and a fourth inlet opening 110. The set of inlet openings can be registered with the cylinder exhaust ports of an internal combustion engine.

The exhaust manifold shown in FIG. 8 includes a first exhaust manifold conduit 112, a second exhaust manifold conduit 114, a third exhaust manifold conduit 116 and a fourth exhaust manifold conduit 118. Each exhaust manifold conduit is made from an inner pipe and an outer pipe disposed around the inner pipe. The exhaust manifold conduits are connected to the set of inlet openings. The first exhaust manifold conduit 112 is connected to the first inlet opening 104. The second exhaust manifold conduit 114 is connected to the second inlet opening 106. The third exhaust manifold conduit 116 is connected to the third inlet opening 108. The fourth exhaust manifold conduit 118 is connected to the fourth inlet opening 110. The four exhaust manifold conduits converge and are joined together at their respective downstream portions.

Referring to FIG. 8, the outlet flange 102 defines an outlet opening 120, which has a substantially circular cross-sectional configuration. The second exhaust manifold conduit 114 and the third exhaust manifold conduit 116 pass through and extend from the outlet opening 120. The first exhaust manifold conduit 112 and the fourth exhaust manifold conduit 118 terminate within the outlet opening 120 at the inlet end of an attached exhaust pipe.

FIG. 9 shows a side view of the exhaust manifold taken in the direction of the arrow E of FIG. 8. With reference to FIG. 9, the set of exhaust manifold conduits is coupled to the inlet openings of the inlet flange 100. The downstream portions of the second exhaust manifold conduit 114 (FIG. 8) and the third exhaust manifold conduit 116 (FIG. 8) extend through the outlet flange 102.

FIG. 10 is a sectional view taken along the line F—F of FIG. 9. The downstream portion of each exhaust manifold conduit has a triangular wedge-shaped cross-sectional configuration including a convex perimeter wall and a pair of interior concave side walls. The downstream portion 122 of the third exhaust manifold conduit 116 and the downstream portion 124 of the second exhaust manifold conduit 114 are positioned adjacent each other and extend an additional length from the outlet flange 102. Connecting an exhaust pipe to the downstream face of the outlet flange 102 will encase the downstream portions 124, 122 of the second exhaust manifold conduit 114 and the third exhaust manifold conduit 116 that protrude from the outlet flange 102. The downstream portion of the first exhaust manifold conduit 112 and the downstream portion of the fourth exhaust manifold conduit 118 terminate within the outlet opening 120 at the inlet end of the exhaust pipe.

The body of the exhaust pipe surrounding the downstream portions 122, 124 of the third exhaust manifold conduit 116 and the second exhaust manifold conduit 114 creates two channels positioned adjacent each other. Each of the two channels has substantially the same cross-sectional shape and size as the associated downstream portion of the first exhaust manifold conduit 112 or the fourth exhaust manifold conduit 118 with which it communicates. The adjacent channels defined by the body of the exhaust pipe and the downstream portions 124, 122 of the second and third exhaust manifold conduits have a total cross-sectional area that is approximately the same as the total cross-sectional area of the downstream portions 124, 122. In this embodiment, the conduits that pass through and extend from the outlet flange 102 into an exhaust pipe do not need to be welded or secured to support each other.

While several particular forms of the invention have been illustrated and described, it will also be apparent that various modifications can be made without departing from the spirit and scope of the invention.

What is claimed is:

1. An exhaust system for an internal combustion engine, comprising:

an exhaust manifold;

an exhaust pipe coupled to the exhaust manifold, the exhaust pipe having a body defining an inlet end;

the exhaust manifold including a first exhaust manifold conduit and a second exhaust manifold conduit, the first exhaust manifold conduit having a first downstream portion that extends into the exhaust pipe, the second exhaust manifold conduit having a second downstream portion that terminates at the inlet end, wherein the first exhaust manifold conduit and the second exhaust manifold conduit are each made from an inner pipe and an outer pipe disposed around the inner pipe, wherein a space between the inner pipe and the outer pipe extends between pipe ends; and a channel within the exhaust pipe defined by the first downstream portion and the body of the exhaust pipe, the channel communicating with the second downstream portion, and wherein the first downstream portion and the second downstream portion converge toward each other.

2. The exhaust system of claim 1, wherein:

the first downstream portion and the second downstream portion are joined together.

3. The exhaust system of claim 1, wherein:

the channel has a cross-sectional configuration approximately the same size and shape as that of the second downstream portion.

4. The exhaust system of claim 1, wherein:

the first downstream portion has a first D-shaped cross-sectional configuration, and the second downstream portion has a second D-shaped cross-sectional configuration.

5. The exhaust system of claim 1, wherein:

the first downstream portion presents a first flat side wall, and the channel is defined by the first flat side wall and the body of the exhaust pipe.

6. A method for manufacturing an exhaust system for an internal combustion engine, comprising the steps of:

providing a first exhaust manifold conduit having a first downstream portion presenting a first flat side wall, a second exhaust manifold conduit having a second downstream portion presenting a second flat side wall, and wherein each of the first exhaust manifold conduit and the second exhaust manifold conduit includes an inner pipe and an outer pipe disposed around the inner pipe, wherein a space between the inner pipe and the outer pipe extends between pipe ends;

connecting an exhaust pipe having a body defining an inlet end to the first exhaust manifold conduit and the second exhaust manifold conduit; and extending the first downstream portion into the exhaust pipe such that a channel within the exhaust pipe is defined by the first flat side wall and the body of the exhaust pipe, the channel communicating with the second downstream portion and wherein the first side wall and the second flat side wall are in confronting relation.

7. The method of claim 6, further comprising the step of:

terminating the second downstream portion at the inlet end of the exhaust pipe.

8. The method of claim 6, wherein:

the channel has a cross-sectional configuration approximately the same size and shape as that of the second downstream portion.

9. The method of claim 6, wherein:

the first downstream portion has a first D-shaped cross-sectional configuration, and the second downstream portion has a second D-shaped cross-sectional configuration.

10. An exhaust system for an internal combustion engine, comprising:

a first exhaust manifold conduit having a first downstream portion connected to an exhaust pipe;

a second exhaust manifold conduit having a second downstream portion connected to the exhaust pipe, wherein each of the first exhaust manifold conduit and the second exhaust manifold conduit includes an inner pipe and an outer pipe disposed around the inner pipe, wherein a space between the inner pipe and the outer pipe extends between pipe ends; and the first downstream portion being displaced from the second downstream portion and wherein the first downstream portion and the second downstream portion converse toward each other.

11. The exhaust manifold of claim 10, wherein:

the first downstream portion and the second downstream portion are joined together.

12. The exhaust manifold of claim 10, wherein:

the first downstream portion presents a first flat side wall, the second downstream portion presents a second flat side wall, and the first flat side wall and the second flat side wall are in confronting relation.

13. The exhaust manifold of claim 10, wherein:

the first downstream portion has a first D-shaped cross-sectional configuration, and the second downstream portion has a second D-shaped cross-sectional configuration.

14. An exhaust system for an internal combustion engine, comprising:

a first exhaust manifold conduit having a first downstream portion conveying a first stream of exhaust gas into an exhaust pipe;

a second exhaust manifold conduit having a second downstream portion conveying a second stream of exhaust gas into the exhaust pipe and wherein the first downstream portion and the second downstream portion converge toward each other;

means, disposed at least partially within the exhaust pipe, for increasing the lengths of the first exhaust manifold conduit and the second exhaust manifold conduit such that the first stream of exhaust gas and the second stream of exhaust gas flow into the exhaust pipe before merging together; and means for separating the first stream of exhaust gas from the second stream of exhaust gas.

15. The exhaust system of claim 14, further comprising:

means for extending the first downstream portion into the exhaust pipe.

16. An exhaust system for an internal combustion engine, comprising:

an exhaust manifold;

an exhaust pipe coupled to the exhaust manifold, the exhaust pipe having a body defining an inlet end;

the exhaust manifold including a plurality of exhaust manifold conduits, a first number of the plurality of exhaust manifold conduits each having a first downstream portion that extends into the exhaust pipe, a second number of the plurality of exhaust manifold conduits each having a second downstream portion that terminates at the inlet end, wherein each of the plurality of exhaust manifold conduits is made from an inner pipe and an outer pipe disposed around the inner pipe, wherein a space between the inner pipe and the outer pipe extends between pipe ends; and a plurality of channels within the exhaust pipe, the plurality of channels having a total cross-sectional area that is approximately the same as the total cross-sectional area of the first downstream portions of the first number of exhaust manifold conduits that extend into the exhaust pipe, wherein the first downstream portion and the second downstream portion converge toward each other.

* * * * *